US010378370B2

(12) United States Patent
Budnick et al.

(10) Patent No.: US 10,378,370 B2
(45) Date of Patent: Aug. 13, 2019

(54) MECHANICAL LINKAGE FOR SEGMENTED HEAT SHIELD

(71) Applicant: United Technologies Corporation, Hartford, CT (US)

(72) Inventors: Matthew Budnick, Hudson, NH (US); Conway Chuong, Manchester, CT (US); Jonathan Ariel Scott, Southington, CT (US)

(73) Assignee: United Technologies Corporation, Farmington, CT (US)

( * ) Notice: Subject to any disclaimer, the term of this patent is extended or adjusted under 35 U.S.C. 154(b) by 536 days.

(21) Appl. No.: 14/655,906

(22) PCT Filed: Dec. 17, 2013

(86) PCT No.: PCT/US2013/075632
§ 371 (c)(1),
(2) Date: Jun. 26, 2015

(87) PCT Pub. No.: WO2014/105512
PCT Pub. Date: Jul. 3, 2014

(65) Prior Publication Data

US 2015/0354410 A1 Dec. 10, 2015

Related U.S. Application Data

(60) Provisional application No. 61/747,236, filed on Dec. 29, 2012.

(51) Int. Cl.
*F01D 9/04* (2006.01)
*F01D 25/14* (2006.01)
(Continued)

(52) U.S. Cl.
CPC ..... *F01D 9/041* (2013.01); *F01D 25/145* (2013.01); *F01D 25/162* (2013.01); *F01D 25/24* (2013.01);
(Continued)

(58) Field of Classification Search
CPC ..... F01D 25/145; F01D 25/24; F01D 25/28; F01D 25/30; F02C 7/24; F02K 1/822
See application file for complete search history.

(56) References Cited

U.S. PATENT DOCUMENTS 2,214,108 A 7/1940 Nichols
2,869,941 A 1/1959 Shoup, Jr. et al.
(Continued)

FOREIGN PATENT DOCUMENTS

CH 705513 A2 3/2013
EP 2187019 A1 5/2010
(Continued)

OTHER PUBLICATIONS

Extended European Search Report for Application No. 13868006.1, dated Jul. 28, 2016, 8 Pages.
(Continued)

*Primary Examiner* — David E Sosnowski
*Assistant Examiner* — Cameron A Corday
(74) *Attorney, Agent, or Firm* — Kinney & Lange, P.A.

(57) ABSTRACT

A turbine exhaust case comprises a frame, a fairing, a heat shield and a mechanical linkage. The frame comprises an outer ring, an inner ring, and a plurality of struts joining the outer ring and the inner ring. The fairing comprising a ring-strut-ring structure disposed within the frame. The heat shield is disposed between the frame and the fairing. The mechanical linkage couples the heat shield to the fairing. In one embodiment, the heat shield comprises a multi-piece heat shield that inhibits heat transfer between the frame and
(Continued)

the fairing. In various embodiments, the mechanical linkage comprises a slip joint or a fixed joint for coupling the heat shield to the fairing.

12 Claims, 8 Drawing Sheets

(51) Int. Cl.
*F01D 25/24* (2006.01)
*F01D 25/28* (2006.01)
*F01D 25/30* (2006.01)
*F01D 25/16* (2006.01)

(52) U.S. Cl.
CPC ..... *F01D 25/246* (2013.01); *F01D 25/28* (2013.01); *F01D 25/30* (2013.01); *F05D 2220/32* (2013.01); *F05D 2240/15* (2013.01); *F05D 2260/231* (2013.01); *F05D 2260/30* (2013.01); *F05D 2260/31* (2013.01)

(56) References Cited

U.S. PATENT DOCUMENTS 2,928,648 A 3/1960 Haines et al.
3,313,105 A 4/1967 Johnson
3,576,328 A 4/1971 Vose
3,802,046 A 4/1974 Wachtell et al.
3,970,319 A 7/1976 Carroll et al.
4,009,569 A 3/1977 Kozlin
4,044,555 A 4/1977 McLoughlin et al.
4,088,422 A 5/1978 Martin
4,114,248 A 9/1978 Smith et al.
4,305,697 A 12/1981 Cohen et al.
4,321,007 A 3/1982 Dennison et al.
4,369,016 A 1/1983 Dennison
4,478,551 A 10/1984 Honeycutt, Jr. et al.
4,645,217 A 2/1987 Honeycutt, Jr. et al.
4,678,113 A 7/1987 Bridges et al.
4,738,453 A 4/1988 Ide
4,756,536 A 7/1988 Belcher
4,793,770 A 12/1988 Schonewald et al.
4,920,742 A 5/1990 Nash et al.
4,987,736 A * 1/1991 Ciokajlo ..... F01D 9/065 415/138
4,989,406 A 2/1991 Vdoviak et al.
4,993,918 A 2/1991 Myers et al.
5,031,922 A 7/1991 Heydrich
5,042,823 A 8/1991 Mackay et al.
5,071,138 A 12/1991 Mackay et al.
5,076,049 A 12/1991 VonBenken et al.
5,100,158 A 3/1992 Gardner
5,108,116 A 4/1992 Johnson et al.
5,169,159 A 12/1992 Pope et al.
5,174,584 A 12/1992 Lahrman
5,188,507 A 2/1993 Sweeney
5,211,536 A * 5/1993 Ackerman ..... F01D 9/042 415/177
5,211,541 A 5/1993 Fledderjohn et al.
5,236,302 A 8/1993 Weisgerber et al.
5,246,295 A 9/1993 Ide
5,265,807 A 11/1993 Steckbeck et al.
5,269,057 A 12/1993 Mendham
5,271,714 A * 12/1993 Shepherd ..... F01D 25/246 415/189
5,272,869 A 12/1993 Dawson et al.
5,273,397 A 12/1993 Czachor et al.
5,292,227 A 3/1994 Czachor et al.
5,312,227 A 5/1994 Grateau et al.
5,338,154 A 8/1994 Meade et al.
5,357,744 A 10/1994 Czachor et al.
5,370,402 A 12/1994 Gardner et al.
5,385,409 A 1/1995 Ide
5,401,036 A 3/1995 Basu
5,438,756 A 8/1995 Halchak et al.
5,474,305 A 12/1995 Flower
5,483,792 A 1/1996 Czachor et al.
5,558,341 A 9/1996 McNickle et al.
5,597,286 A * 1/1997 Dawson ..... F01D 9/065 415/115
5,605,438 A 2/1997 Burdgick et al.
5,609,467 A 3/1997 Lenhart et al.
5,632,493 A 5/1997 Gardner
5,634,767 A 6/1997 Dawson
5,691,279 A 11/1997 Tauber et al.
5,755,445 A 5/1998 Arora
5,851,105 A 12/1998 Fric et al.
5,911,400 A 6/1999 Niethammer et al.
6,163,959 A * 12/2000 Arraitz ..... F01D 9/065 29/889.1
6,196,550 B1 3/2001 Arora et al.
6,227,800 B1 5/2001 Spring et al.
6,337,751 B1 1/2002 Kimizuka
6,343,912 B1 2/2002 Mangeiga et al.
6,358,001 B1 3/2002 Bosel et al.
6,364,316 B1 4/2002 Arora
6,439,841 B1 8/2002 Bosel
6,463,739 B1 10/2002 Mueller et al.
6,511,284 B2 1/2003 Darnell et al.
6,578,363 B2 6/2003 Hashimoto et al.
6,601,853 B2 8/2003 Inoue
6,612,807 B2 9/2003 Czachor
6,619,030 B1 9/2003 Seda et al.
6,638,013 B2 10/2003 Nguyen et al.
6,652,229 B2 11/2003 Lu
6,672,833 B2 1/2004 MacLean et al.
6,719,524 B2 4/2004 Nguyen et al.
6,736,401 B2 5/2004 Chung et al.
6,792,758 B2 9/2004 Dowman
6,796,765 B2 9/2004 Kosel et al.
6,805,356 B2 10/2004 Inoue
6,811,154 B2 11/2004 Proctor et al.
6,935,631 B2 8/2005 Inoue
6,969,826 B2 11/2005 Trewiler et al.
6,983,608 B2 1/2006 Allen, Jr. et al.
7,055,305 B2 6/2006 Baxter et al.
7,094,026 B2 8/2006 Coign et al.
7,100,358 B2 9/2006 Gekht et al.
7,200,933 B2 4/2007 Lundgren et al.
7,229,249 B2 6/2007 Durocher et al.
7,238,008 B2 7/2007 Bobo et al.
7,367,567 B2 5/2008 Farah et al.
7,371,044 B2 5/2008 Nereim
7,373,773 B2 * 5/2008 Noda ..... F01D 5/081 60/266
7,389,583 B2 6/2008 Lundgren
7,614,150 B2 11/2009 Lundgren
7,631,879 B2 12/2009 Diantonio
7,673,461 B2 3/2010 Cameriano et al.
7,677,047 B2 3/2010 Somanath et al.
7,735,833 B2 6/2010 Braun et al.
7,798,768 B2 9/2010 Strain et al.
7,815,417 B2 10/2010 Somanath et al.
7,824,152 B2 11/2010 Morrison
7,891,165 B2 2/2011 Bader et al.
7,909,573 B2 3/2011 Cameriano et al.
7,955,446 B2 6/2011 Dierberger
7,959,409 B2 6/2011 Guo et al.
7,988,799 B2 8/2011 Dierberger
8,069,648 B2 12/2011 Snyder et al.
8,083,465 B2 12/2011 Herbst et al.
8,091,371 B2 1/2012 Durocher et al.
8,092,161 B2 1/2012 Cai et al.
8,152,451 B2 4/2012 Manteiga et al.
8,162,593 B2 4/2012 Guimbard et al.
8,172,526 B2 5/2012 Lescure et al.
8,177,488 B2 5/2012 Manteiga et al.
8,221,071 B2 7/2012 Wojno et al.
8,245,399 B2 8/2012 Anantharaman et al.
8,245,518 B2 8/2012 Durocher et al.
8,282,342 B2 10/2012 Tonks et al.
8,371,127 B2 2/2013 Durocher et al.
8,371,812 B2 2/2013 Manteiga et al.

(56) References Cited

U.S. PATENT DOCUMENTS

| | | | | |
|---|---|---|---|---|
| 8,511,969 | B2 * | 8/2013 | Durocher | F01D 5/18 415/115 |
| 2002/0182058 | A1 | 12/2002 | Darnell et al. | |
| 2003/0025274 | A1 | 2/2003 | Allan et al. | |
| 2003/0042682 | A1 | 3/2003 | Inoue | |
| 2003/0062684 | A1 | 4/2003 | Inoue | |
| 2003/0062685 | A1 | 4/2003 | Inoue | |
| 2005/0046113 | A1 | 3/2005 | Inoue | |
| 2005/0050898 | A1 | 3/2005 | Noda | |
| 2006/0010852 | A1 | 1/2006 | Gekht et al. | |
| 2006/0123796 | A1 | 6/2006 | Aycock et al. | |
| 2007/0025847 | A1 | 2/2007 | Wakazono et al. | |
| 2008/0216300 | A1 | 9/2008 | Anderson et al. | |
| 2010/0054927 | A1 | 3/2010 | Almstedt et al. | |
| 2010/0132371 | A1 | 6/2010 | Durocher et al. | |
| 2010/0132374 | A1 | 6/2010 | Manteiga et al. | |
| 2010/0132377 | A1 | 6/2010 | Durocher et al. | |
| 2010/0150712 | A1 | 6/2010 | Khanin et al. | |
| 2010/0202872 | A1 | 8/2010 | Weidmann | |
| 2010/0236244 | A1 | 9/2010 | Longardner | |
| 2010/0275572 | A1 | 11/2010 | Durocher et al. | |
| 2010/0275614 | A1 | 11/2010 | Fontaine et al. | |
| 2010/0307165 | A1 | 12/2010 | Wong et al. | |
| 2011/0000223 | A1 | 1/2011 | Russberg | |
| 2011/0005234 | A1 | 1/2011 | Hashimoto et al. | |
| 2011/0020116 | A1 | 1/2011 | Hashimoto et al. | |
| 2011/0061767 | A1 | 3/2011 | Vontell et al. | |
| 2011/0081237 | A1 * | 4/2011 | Durocher | F01D 9/06 415/173.1 |
| 2011/0081239 | A1 | 4/2011 | Durocher | |
| 2011/0081240 | A1 | 4/2011 | Durocher et al. | |
| 2011/0085895 | A1 | 4/2011 | Durocher et al. | |
| 2011/0214433 | A1 | 9/2011 | Feindel et al. | |
| 2011/0262277 | A1 | 10/2011 | Sjoqvist et al. | |
| 2011/0302929 | A1 | 12/2011 | Bruhwiler | |
| 2012/0111023 | A1 | 5/2012 | Sjoqvist et al. | |
| 2012/0156020 | A1 | 6/2012 | Kottilingam et al. | |
| 2012/0186254 | A1 | 7/2012 | Ito et al. | |
| 2012/0204569 | A1 | 8/2012 | Schubert | |
| 2012/0227371 | A1 | 9/2012 | Johnson et al. | |
| 2013/0011242 | A1 | 1/2013 | Beeck et al. | |
| 2013/0223982 | A1 * | 8/2013 | Durocher | F16B 5/04 415/12 |
| 2014/0007588 | A1 * | 1/2014 | Sanchez | F01D 9/065 60/796 |

FOREIGN PATENT DOCUMENTS

| | | | |
|---|---|---|---|
| WO | WO 03/020469 | A1 | 3/2003 |
| WO | WO 20061007686 | A1 | 1/2006 |
| WO | WO 20091157817 | A1 | 12/2009 |
| WO | WO 2010002296 | A1 | 1/2010 |
| WO | WO 20101002295 | A1 | 1/2010 |
| WO | WO 2011129724 | A1 | 10/2011 |
| WO | WO 20121158070 | A1 | 11/2012 |

OTHER PUBLICATIONS

International Searching Authority, PCT Notification of Transmittal of the International Search Report and the Written Opinion, dated Mar. 31, 2014, 13 pages.

* cited by examiner

MECHANICAL LINKAGE FOR SEGMENTED HEAT SHIELD

BACKGROUND

The present disclosure relates generally to gas turbine engine load bearing cases. More particularly, the present disclosure relates to systems for mounting heat shields between a structural frame and a flow path fairing in a turbine exhaust case.

Turbine Exhaust Cases (TEC) typically comprise structural frames that support the very aft end of a gas turbine engine. In aircraft applications, the TEC can be utilized to mount the engine to the aircraft airframe. In industrial gas turbine applications, the TEC can be utilized to couple the gas turbine engine to an electrical generator. A typical TEC comprises an outer ring that couples to the outer diameter case of the low pressure turbine, an in inner ring that surrounds the engine centerline so as to support shafting in the engine, and a plurality of struts connecting the inner and outer rings. As such, the TEC is typically subject to various types of loading, thereby requiring the TEC to be structurally strong and rigid. Due to the placement of the TEC within the hot gas stream exhausted from a combustor of the gas turbine engine, it is typically desirable to shield the TEC structural frame with a fairing that is able to withstand direct impingement of the hot gases. The fairing additionally takes on a ring-strut-ring configuration wherein the vanes are hollow to surround the frame struts. The structural frame and the fairing can each be made of materials optimized for their respective functions.

In order to further protect the TEC structural frame, heat shields are disposed between the frame and the fairing. The heat shields provide thermal protection to the structural frame by inhibiting conductive heat transfer from the fairing to the structural frame. The heat shields thereby assist in limiting thermal expansion and distortion of the TEC structural frame, which may adversely affect alignment of components interacting with the TEC, such as the low pressure turbine case and shaft. It is desirable to attach the heat shield within the TEC to prevent vibration of the heat shield and the resulting wear vibration produces. Conventionally, heat shields have been welded to the TEC structural frame. Welded joints are, however, undesirable due to the resulting inability to easily remove the heat shields. Heat shields have also been "spring-loaded" or biased against the frame or fairing to prevent vibration. However, such designs are not robust enough for industrial gas turbine engine applications. There is, therefore, a need for improved coupling arrangements for heat shields in gas turbine engine structural components.

SUMMARY

The present disclosure is directed to a system for mounting a heat shield to a fairing in a turbine structural case. A turbine exhaust case comprises a frame, a fairing, a heat shield and a mechanical linkage. The frame comprises an outer ring, an inner ring, and a plurality of struts joining the outer ring and the inner ring. The fairing comprising a ring-strut-ring structure disposed within the frame. The heat shield is disposed between the frame and the fairing. The mechanical linkage couples the heat shield to the fairing. In one embodiment, the heat shield comprises a multi-piece heat shield that inhibits heat transfer between the frame and the fairing. In various embodiments, the mechanical linkage comprises a slip joint or a fixed joint for coupling the heat shield to the fairing.

DETAILED DESCRIPTION

Figure 1:
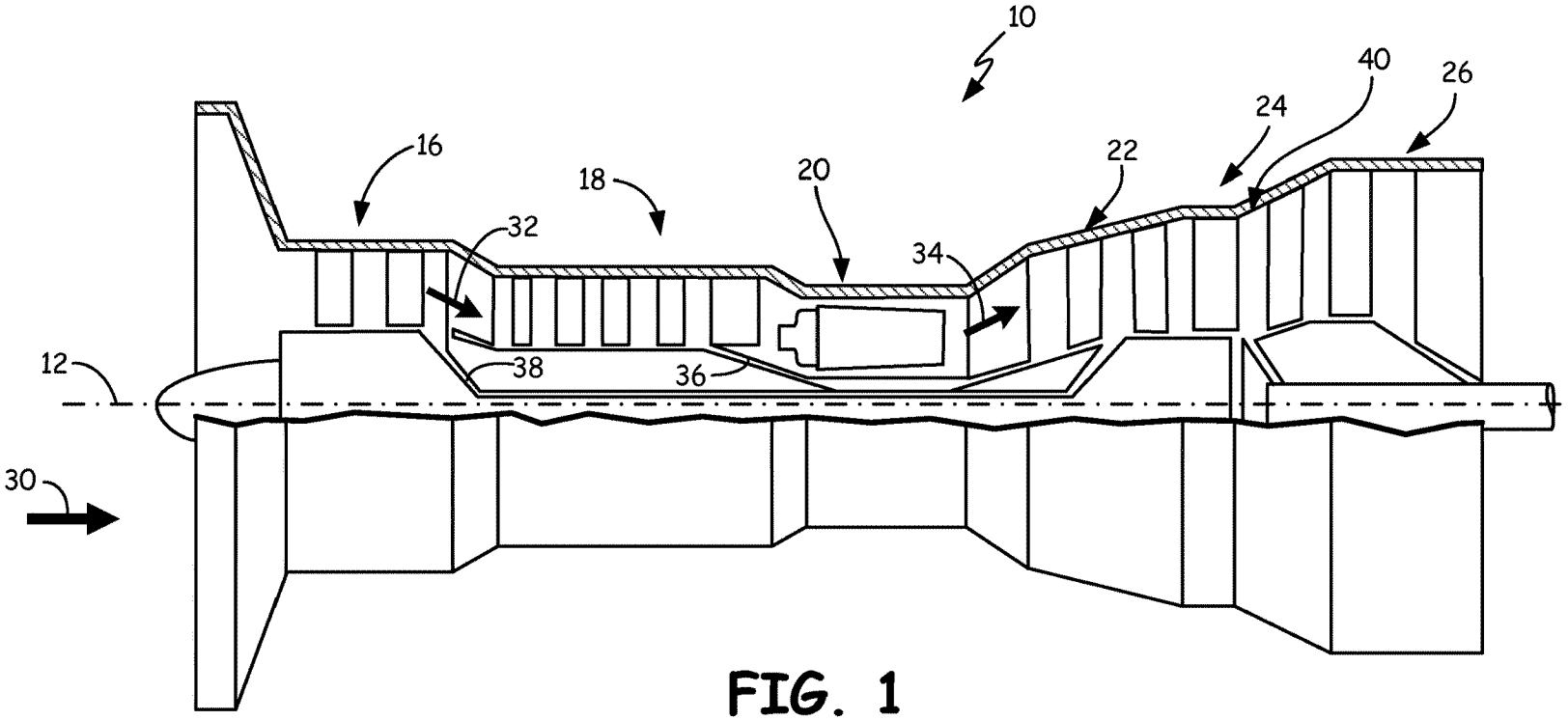
FIG. 1 is a side sectional schematic view of an industrial gas turbine engine having a turbine exhaust case.

FIG. 1 is a side partial sectional schematic view of gas turbine engine 10. In the illustrated embodiment, gas turbine engine 10 is an industrial gas turbine engine circumferentially disposed about a central, longitudinal axis or axial engine centerline axis 12 as illustrated in FIG. 1. Gas turbine engine 10 includes, in series order from front to rear, low pressure compressor section 16, high pressure compressor section 18, combustor section 20, high pressure turbine section 22, and low pressure turbine section 24. In some embodiments, power turbine section 26 is a free turbine section disposed aft of the low pressure turbine 24.

As is well known in the art of gas turbines, incoming ambient air 30 becomes pressurized air 32 in the low and high pressure compressor sections 16 and 18. Fuel mixes with pressurized air 32 in combustor section 20, where it is burned. Once burned, combustion gases 34 expand through high and low pressure turbine sections 22 and 24 and through power turbine section 26. High and low pressure turbine sections 22 and 24 drive high and low pressure rotor shafts 36 and 38 respectively, which rotate in response to flow of combustion gases 34 and thus rotate the attached high and low pressure compressor sections 18 and 16. Power turbine section 26 may, for example, drive an electrical generator, pump, or gearbox (not shown).

Low Pressure Turbine Exhaust Case (LPTEC) 40 is positioned between low pressure turbine section 24 and power turbine section 26. LPTEC 40 defines a flow path for gas exhausted from low pressure turbine section 24 that is conveyed to power turbine 26. LPTEC 40 also provides structural support for gas turbine engine 10 so as to provide a coupling point for power turbine section 26. LPTEC 40 is therefore rigid and structurally strong. The present disclosure relates generally to mechanical linkage coupling systems for heat shields and fairings within LPTEC 40.

It is understood that FIG. 1 provides a basic understanding and overview of the various sections and the basic operation of an industrial gas turbine engine. It will become apparent to those skilled in the art that the present application is applicable to all types of gas turbine engines, including those with aerospace applications. Similarly, although the present disclosure is described with reference to sealing arrangements for LPTEC 40, the present disclosure is applicable to other components of gas turbine engines, such as intermediate cases, mid-turbine frames and the like.

Figure 2A:
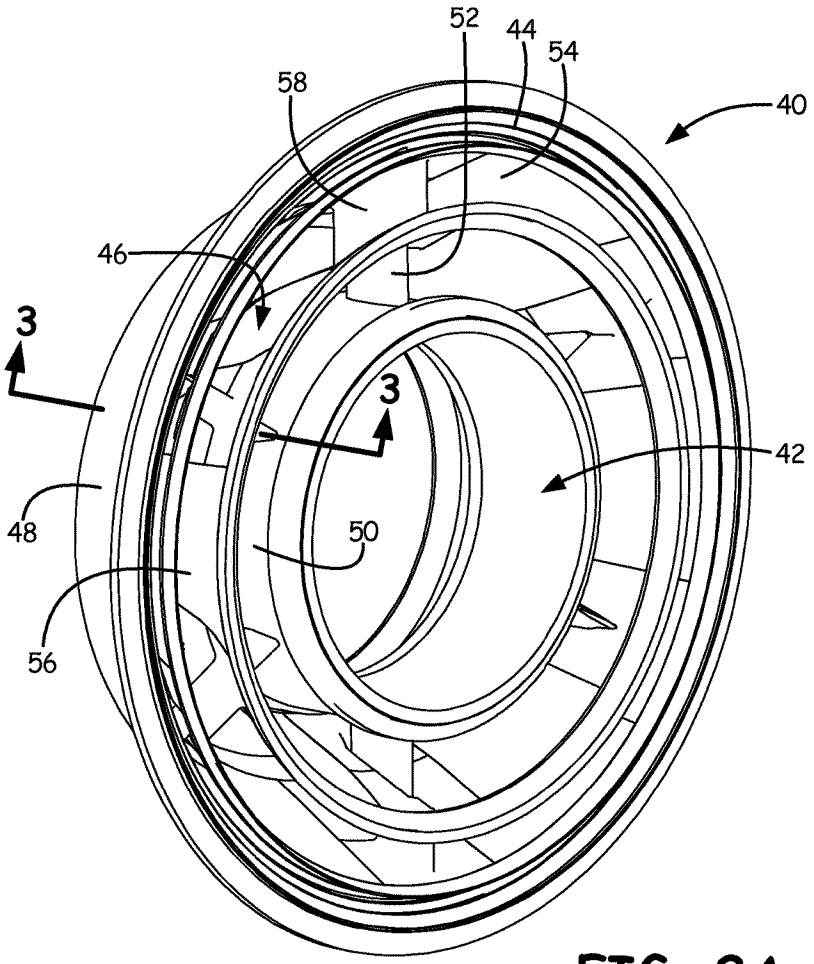
FIG. 2A is a perspective view of a turbine exhaust case in which a ring-strut-ring fairing is assembled with a ring-strut-ring frame.
Figure 2B:
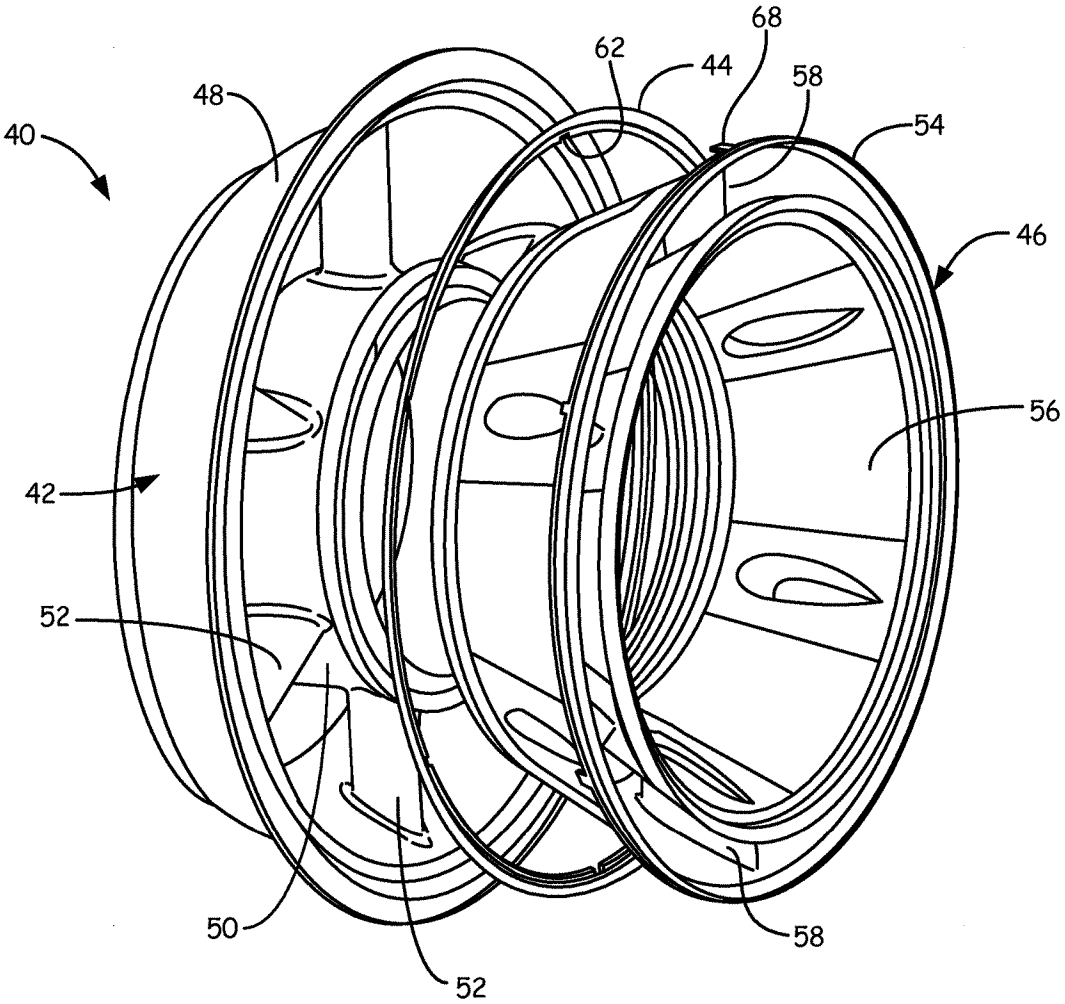
FIG. 2B is an exploded view of the turbine exhaust case of FIG. 2A showing the frame, the fairing and a circumferential stop ring.

FIG. 2A shows a perspective view of Low Pressure Turbine Exhaust Case (LPTEC) 40, which includes frame 42, annular mount 44, and fairing 46. FIG. 2B, which is discussed concurrently with FIG. 2A, shows an exploded view of LPTEC 40 showing annular mount 44 disposed between fairing 46 and frame 42. Frame 42 includes outer ring 48, inner ring 50, and struts 52. Fairing 46 includes outer ring 54, inner ring 56, and vanes 58.

Frame 42 comprises a ring-strut-ring structure that combines struts 52, outer ring 48 and inner ring 50 into a load-bearing structure. Fairing 46 also comprises a ring-strut-ring structure that is mounted within frame 42 to define the gas path and protect frame 42 from high temperature exposure. In one embodiment, fairing 46 can be built around frame 42, and in another embodiment, frame 42 is built within fairing 46.

Frame 42 comprises a stator component of gas turbine engine 10 (FIG. 1) that is typically mounted between low pressure turbine section 24 and power turbine section 26. In the embodiment shown, outer ring 48 of frame 42 is conically shaped, while inner ring 50 is cylindrically shaped. Outer ring 48 is connected to inner ring 50 via struts 52. Outer ring 48, inner ring 50 and struts 52 form a portion of the gas flow path through gas turbine engine 10 (FIG. 1). Specifically, outer ring 48 and inner ring 50 are joined by struts 52 to define the structural support, or load path, from the casing to the bearing compartment (not shown).

Fairing 46 is adapted to be disposed within frame 42 between outer ring 48 and inner ring 50. Outer ring 54 and inner ring 56 of fairing 46 have generally conical shapes, and are connected to each other by vanes 58, which act as struts to join rings 54 and 56. Outer ring 54, inner ring 56, and vanes 58, form a liner for the portion of the gas flow path through frame 42. Specifically, vanes 58 encase struts 52, while outer ring 54 and inner ring 56 line inward facing surfaces of outer ring 48 and inner ring 50, respectively. Outer ring 54 and inner ring 56 also define the outer and inner radial boundaries of an annular flow path between low pressure turbine section 24 and power turbine section 26 (FIG. 1), while vanes 58 intermittently interrupt the annular flow path.

Annular mount 44 is interposed between frame 42 and fairing 46 and is configured to prevent circumferential rotation of fairing 46 within frame 42. Specifically, lugs 68 extend axially into slots 62 to prevent circumferential rotation of fairing 46, while permitting radial and axial movement of fairing 46 relative to frame 42.

Figure 3:
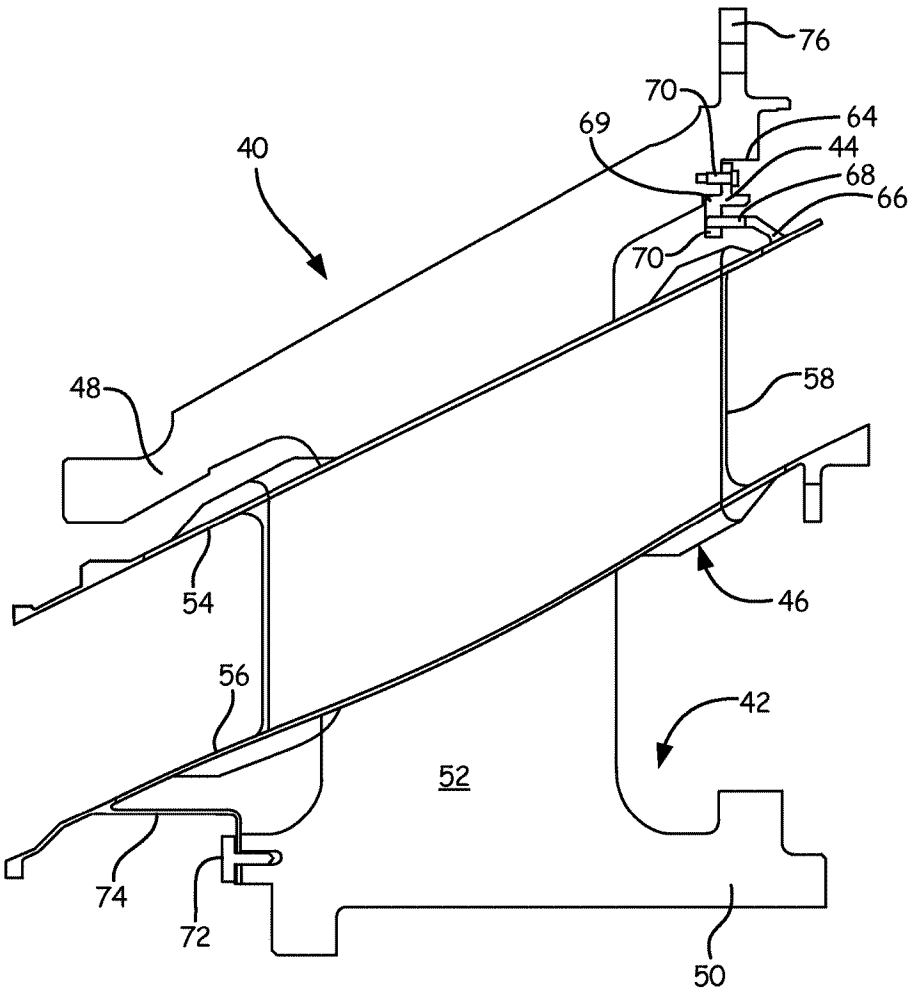
FIG. 3 is a cross-sectional view of the turbine exhaust case of FIG. 2A showing the circumferential stop ring linking the fairing to the frame.

FIG. 3 shows a cross-section of LPTEC 40 having fairing 46 installed within frame 42 utilizing annular mount 44, which includes anti-rotation flange 60 and lugs 62. Frame 42 includes outer ring 48, inner ring 50, strut 52 and counterbore 64. Fairing 46 includes outer ring 54, inner ring 56, vane 58. Outer ring 54 includes anti-rotation flange 66 with slots 68. LPTEC 40 further comprises fasteners 70, fasteners 72 and mount ring 74. Frame 42 also includes other features, such as flange 77, to permit frame 42 to be mounted to components of gas turbine engine 10 (FIG. 1), such as low pressure turbine section 24, power turbine section 26 or an exhaust nozzle.

Mount ring 74 extends from inner ring 56 of fairing 46 and engages an axial end of inner ring 50 of frame 42. Mount ring 74 is connected via second fasteners 72 (only one is shown in FIG. 3). Thus, fairing 46 has a fixed connection (i.e., is radially, axially, and circumferentially constrained relative to the frame 42) to frame 42 at a first location.

Fairing 46 has a floating connection (i.e. has axial and radial degrees of freedom) to frame 42 at a second connection through engagement of flange 66 with annular mount 44. Annular mount 44 is attached to an axial end of outer ring 48 by fasteners 70 (only one is shown in FIG. 3) at counterbore 64. Outer ring 54 of fairing 46 includes flange 66 that engages flange 60 of annular mount 44. Flanges 66 and 60 are castellated to form mating arrays of circumferential slots and lugs. In particular, lugs 68 (only one in shown in FIG. 3) of flange 66 mate with slots 62 (only one in shown in FIG. 3) of flange 60, but allow fairing 46 to move both radially and axially (although only a limited amount) relative to frame 42. Slots 62 are connected to and extend generally radially outward into flange 60. Lugs 68 are connected to and extend generally axially forward from flange 66. Flanges 66 and 60 act to constrain fairing 46 from circumferential movement relative to frame 42 and annular mount 44.

Figure 4:
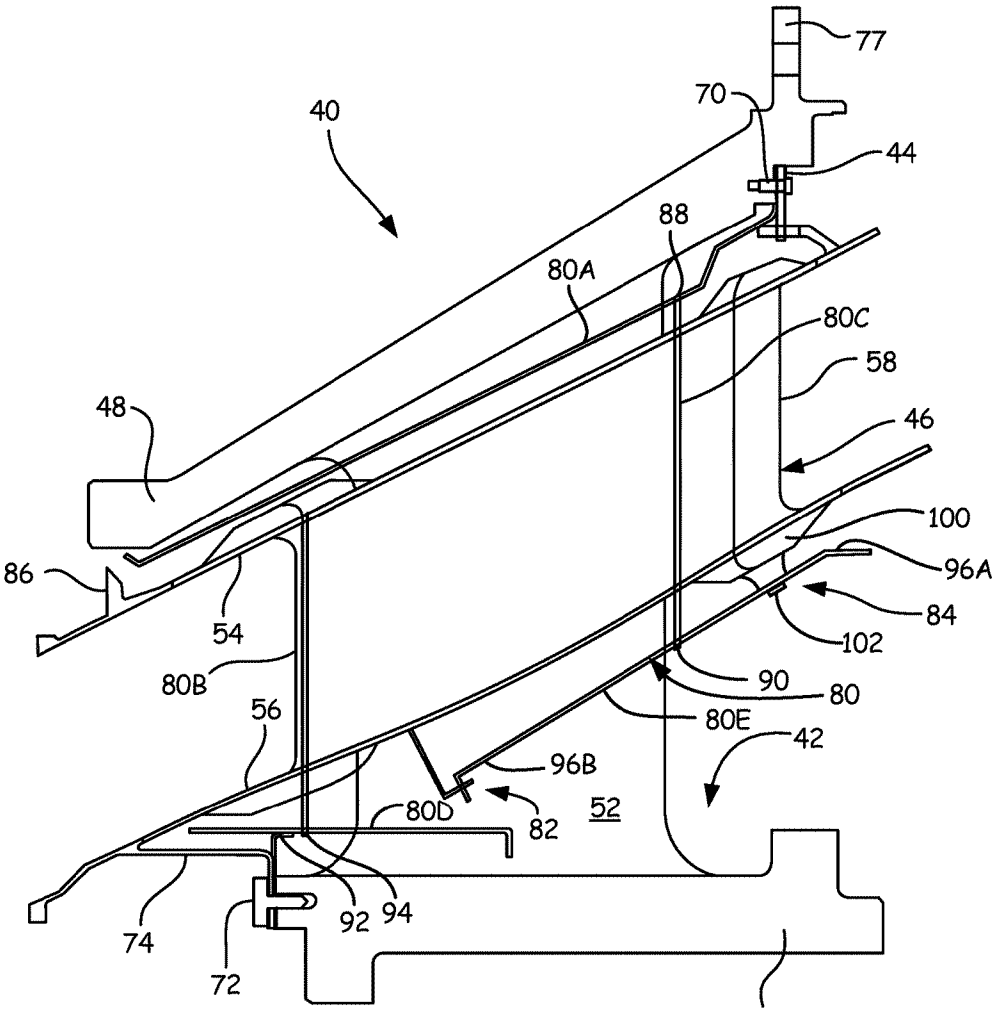
FIG. 4 is a cross-sectional view of an embodiment of the turbine exhaust case of FIG. 2A showing a heat shield coupled to the fairing using a fixed joint and a slip joint.

FIG. 4 is a cross-sectional view of an embodiment of turbine LPTEC 40 of FIG. 2A showing heat shield 80 coupled to fairing 46 using slip joint 82 and fixed joint 84. Heat shield 80 is segmented such that it comprises outer heat shield segment 80A, forward heat shield segment 80B, aft heat shield segment 80C and inner heat shield segments 80D and 80E. Frame 42 and fairing 46 include components and elements as are described with reference to FIGS. 1-3 and like reference numerals are used in FIG. 4. Heat shield 80 is positioned between frame 42 and fairing 46 to inhibit heat of gas flowing through fairing 46 from radiating to frame 42. Heat shield 80 comprises a plurality of thin-walled bodies that are coupled to frame 42 and fairing 46 at various junctures.

Outer heat shield segment 80A comprises a conical sheet positioned between outer ring 54 of fairing 46 and outer ring 48 of frame 42. Outer heat shield segment 80A includes openings to permit struts 52 to pass through. Outer heat shield segment 80A is joined to frame 42 using fastener 70. Fastener 70 passes through a bore within heat shield 80 and into a threaded bore within outer ring 48 at the juncture where annular mount 44 is joined to frame 42. Thus, heat outer heat shield segment 80A is fixed radially, axially and circumferentially via fastener 70. Outer heat shield segment 80A may also be fixed to fairing 46 at boss 86 using a threaded fastener. Aft heat shield segment 80C is joined to outer heat shield segment 80A at joint 88. Aft heat shield segment 80C is also joined to inner heat shield segment 80E at joint 90. Aft heat shield segment 80C comprises a sheet metal body that is arcuate in the circumferential direction (e.g. "U" shaped) to partially wrap around strut 52. Joints 88 and 90 may comprise mechanical, welded or brazed joints. In other embodiments, aft heat shield segment 80C may be integrally formed with outer heat shield segment 80A and inner heat shield segment 80E, or mechanically attached to vane 58.

Inner heat shield segment 80D comprises an annular sheet positioned between inner ring 56 of fairing 46 and inner ring 50 of frame 42. Similarly, inner heat shield segment 80E comprises a conical sheet positioned between inner ring 56 of fairing 46 and inner ring 50 of frame 42. Inner heat shield segments 80D and 80E include arcuate openings along their perimeter to permit struts 52 to pass through. Specifically, inner heat shield segment 80D includes a U-shaped cut-out along its trailing edge, while inner heat shield segment 80E includes a U-shaped cut-out along its leading edge. Inner heat shield segment 80D is joined to frame 42 using fastener 72 and flange 92, which is joined to and extends radially inward from inner heat shield segment 80D. Fastener 72 passes through a bore within heat shield 80 and into a threaded bore within inner ring 50. Thus, inner heat shield segment 80D is fixed radially, axially and circumferentially via fastener 72 at one end and cantilevered at the opposite end. Forward heat shield segment 80B is joined to inner heat shield segment 80D at joint 94. Forward heat shield segment 80B comprises a sheet metal body that is arcuate in the circumferential direction (e.g. "U" shaped) to partially wrap around strut 52. Forward heat shield segment 80B extends from joint 94 so as to be cantilevered within vane 58 of fairing 46 alongside strut 52. Joint 94 may comprise a mechanical, welded or brazed joint. In other embodiments, forward heat shield segment 80B may be integrally formed with inner heat shield segment 80D, or mechanically attached to vane 58.

Heat shield 80 is divided into a plurality of segments to facilitate assembly into LPTEC 40. Forward heat shield segment 80B is separated from outer heat shield segment 80A, and inner heat shield segments 80D and 80E are separated from each other. Inner heat shield segments 80D and 80E overlap to form a circuitous path. Additionally, inner heat shield segments 80D and 80E overlap to form a line-of-sight obstruction between fairing 46 and frame 42. As such, radiant heat emanating from fairing 46 is inhibited from reaching frame 42. Such a segmented configuration, however, leaves ends of various segments unsupported. For example, inner heat shield segment 80E extends between supported end 96A and unsupported end 96B. It thus becomes desirable to anchor heat shield 80 at additional locations other than those provided by fasteners 70 and 72 at frame 42. Slip joint 82 and fixed joint 84 provide mechanical linkages that couple heat shield 80 to fairing 46. Slip joint 82 includes anchor 98, which provides unsupported end 96B a limited degree of movement. Fixed joint 84 is rigidly secured to fairing 46 at pad 100 using fastener 102 to limit all degrees of movement of supported end 96A.

Slip joint 82 and fixed joint 84 are advantageous in coupling heat shields formed of a plurality of separated segments to fairing 46 or frame 42. In particular, welded joints are difficult to position between concentric components of LPTEC 40. For example, it is difficult to provide a weld at the location of slip joint 82 between inner ring 56 and inner ring 50. As mentioned, welded joints are also semi-permanent and do not allow for easy disassembly and reassembly of heat shield 80. Furthermore, too many welded joints on heat shields do not permit thermal expansion of the heat shield. Slip joint 82, in conjunction with fixed joint 84, allow heat shield to be removably and repetitiously attached fairing 46 in tight or cramped spaces.

Figure 5:
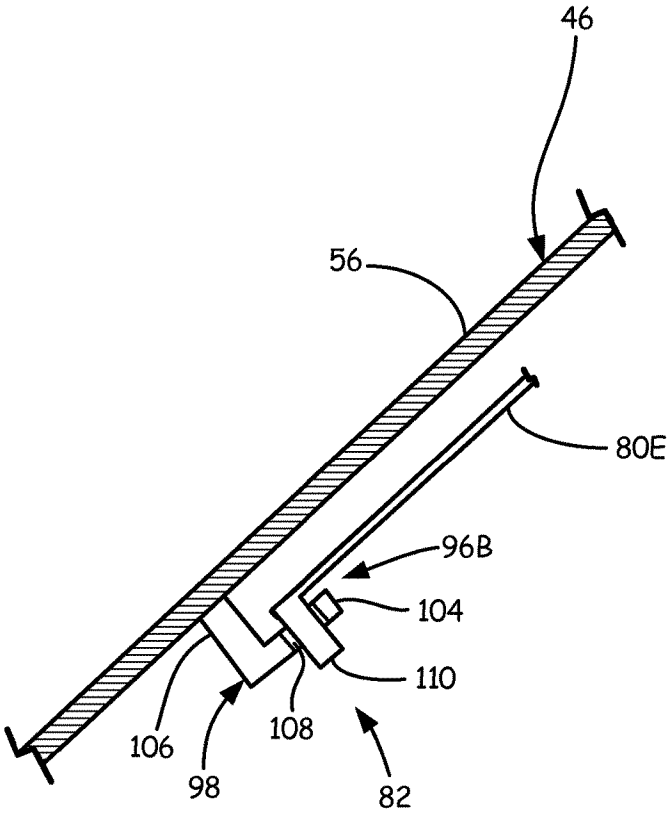
FIG. 5 is a close-up view of a first embodiment of the slip joint of FIG. 4 comprising a shelf.

FIG. 5 is a close-up view of a first embodiment of slip joint 82 of FIG. 4 including anchor 98. Anchor 98 comprises shelf 104 extension 106 and slot 108. Unsupported end 96B of inner heat shield segment 80E includes hook 110. Slip joint 82 comprises a mechanical coupling that loosely secures heat shield 80 to fairing 46. Slip joint 82 is configured to permit inner heat shield segment 80E to move axially and circumferentially, with respect to centerline axis 12 (FIG. 1), while constraining radially movement of unsupported end 96B. As such, heat shield segment 80E can grow due to thermal expansion, but will remain in close proximity to inner ring 56 to provide shielding and to support joint 90 with aft heat shield segment 80E (FIG. 4), and to support fixed joint 84 (FIG. 4).

Anchor 98 extends from inner ring 56 of fairing 46 (FIG. 4) in close proximity to unsupported end 96B. Extension 106 extends radially inward and aftward from inner ring 56. Shelf 104 extends axially aftward and radially outward from extension 106, between inner ring 56 of fairing 46 and inner ring 50 of frame 42 (FIG. 4). Extension 106 is sized to permit hook 110 of inner heat shield segment 80E to slide between inner ring 50 and shelf 104. The height of extension 106 is also sized to permit radial thermal growth of inner heat shield segment 80E. Shelf 104 extends away from extension 106 far enough to form slot 108. Slot 108 comprises a generally axial window that extends through shelf 104 to permit hook 110 to engage anchor 98, thereby limiting the ability of heat shield segment 90E to disengage from anchor 96. The width of slot 108 within shelf 104 can be sized to allow different amounts of thermal expansion of heat shield 80 in the axial direction. Unsupported end 96B thus remains cantilevered when at rest, but is prevented from being displaced beyond the constraints of anchor 96. In another embodiment, unsupported end 96B may be biased against anchor 96 by imparting a spring-like bending load in inner heat shield segment 80E.

In one embodiment, anchor 98 extends around inner ring 56 as a three-hundred-sixty degree ring. In other embodiments, however, anchor 98 may comprise a plurality of intermittent bodies. Although, anchor 98 is depicted in FIG. 5 as an "L" shaped shelf with axial window 108, anchor 98 may have other shapes in other embodiments. For example, anchor 98 may be "J" shaped with an axial window, "U" shaped with both axial and radial windows, or may simply comprise a "straight" projection that limits the ability of unsupported end 96B to separate from inner ring 56. In another embodiment, hook 110 and slot 108 may be omitted from anchor 98. Anchor 98 may be comprised of a synthetic material that can withstand elevated temperatures, or may be a metal or alloy material. Anchor 98 may be integrally formed with inner ring 56 of fairing 46, or may be joined to inner ring 56 as a separate piece.

Slip joint 82 allows inner heat shield segment 80E to be inserted between inner ring 50 and inner ring 56, such as from the aftward, or downstream, end. Unsupported end 96B can be easily mechanically coupled to fairing 46 in the tight space provided between inner ring 50 and inner ring 56, where welding equipment and tools are difficult to reach. Anchor 98 inhibits unsupported end 96B from moving away from inner ring 56, thereby maintaining a line-of-sight thermal barrier between fairing 46 and frame 42 (FIG. 4). Anchor 98 also prevents unlimited vibration of heat shield segment 80E, which reduces wear in heat shield 80. Anchor 98 additionally reduces stress on fixed joint 84 by limiting moment forces in heat shield 80 at fixed joint 84 produced by unsupported end 96B being permitted to freely disengage from inner ring 56.

Figure 6:
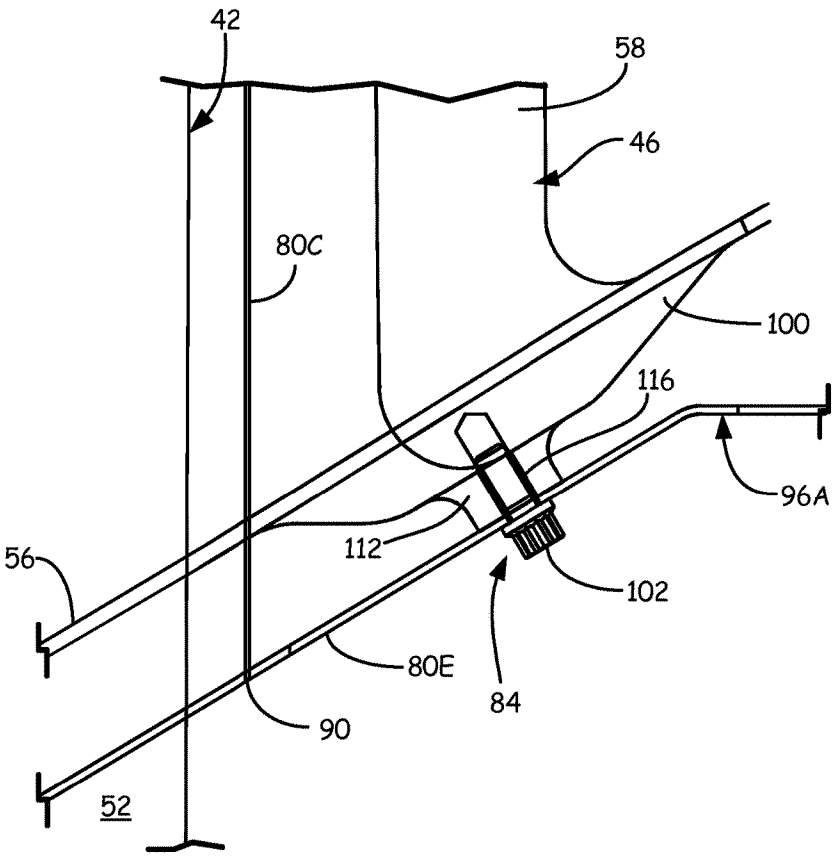
FIG. 6 is a close-up view of an embodiment of the fixed joint of FIG. 4 comprising a threaded boss.

FIG. 6 is a close-up view of an embodiment of fixed joint 84 of FIG. 4 comprising boss 112. Boss 112 projects from inner ring 56 at pad 100, which comprises a thickened portion of fairing 46. Boss 112 includes threaded bore 114, which extends through boss 112 and into pad 100 in the embodiment shown to receive fastener 102. Bore 114 includes locking insert 116, which comprises an annular sleeve having external threads that engage bore 114, and internal threads that engage fastener 102.

Fixed joint 84 comprises a mechanical linkage that rigidly secures heat shield segment 80E to fairing 46. Specifically, fastener 102 pushes heat shield segment 80E against boss 112 to immobilize supported end 96A of heat shield segment 80E. Thus, radial, axial and circumferential movement of heat shield segment 80A is prevented at fixed joint 84. Locking insert 116 provides a mechanical buffer between fairing 46 and fastener 112, thereby preventing fastener 112 from damaging fairing 46. Specifically, locking insert 116 prevents threads of fastener 112 from stripping threads within bore 114 when torque is applied to fastener 112, such as during installation.

Pad 100 comprises an enhanced region of fairing 46 that provides strength to inner ring 46. In particular, inner ring 56 is thickened near the juncture with vane 58 to reduce stress concentration from forming within fairing 46. Thus, pad 100 has sufficient axial and circumferential surface area to surround boss 112. Further description of pad 100 is found in co-pending application Ser. No. 13/730,893, entitled "MULTI-PIECE FAIRING FOR MONOLITHIC TURBINE EXHAUST CASE" which is incorporated herein by this reference. Bore 114 extends into pad 100 to facilitate joining of heat shield segment 80E to fairing 46. Boss 112 comprises a further thickening of inner ring 56 surrounding bore 114, which also extends through boss 112. Boss 112 generally comprises a round pedestal that is concentric with bore 114. The wall thickness of boss 112 is selected so as to provide mechanical support to locking insert 116. Boss 112 provides radial thickening to pad 100 so as to accommodate the length of fastener 102, thereby preventing bore 114 and fastener 102 from extending through inner ring 56 and into the interior region of fairing 46 radially inward of inner ring 56. As such, boss 112 and pad 100 prevent stress from being induced in fairing 46 at fixed joint 84. Additionally, such an arrangement allows pad 100 to serve a dual purpose of structural stiffening between vanes 58 and inner ring 56, as well as a heat shield support location via fastener 102.

Figure 7C:
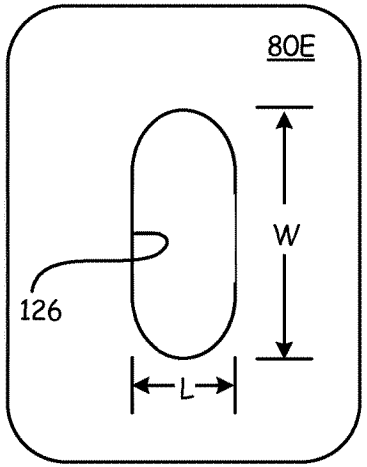
FIG. 7C is a top plan view of a slot in a heat shield through which the bushing of FIG. 7B extends.
Figure 7A:
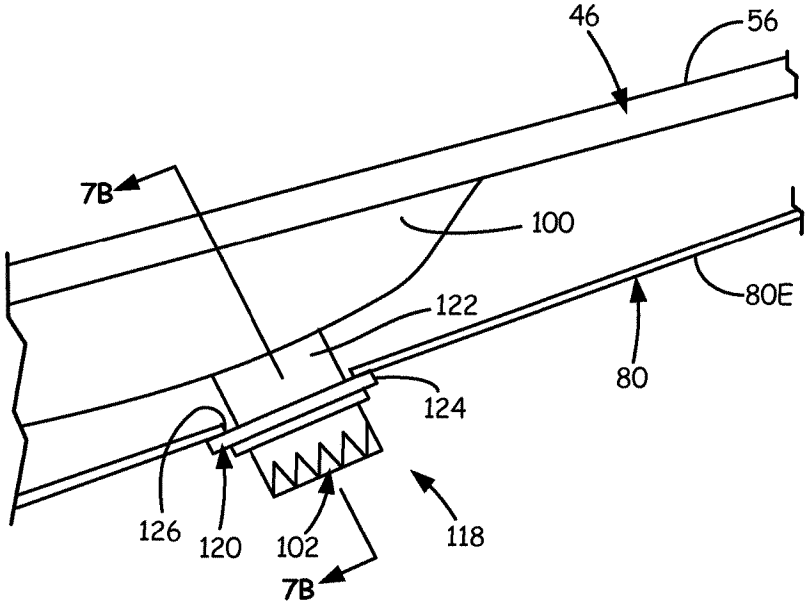
FIG. 7A is a close-up view of a second embodiment of a slip joint suitable for use with the heat shield of FIG. 4.
Figure 7B:
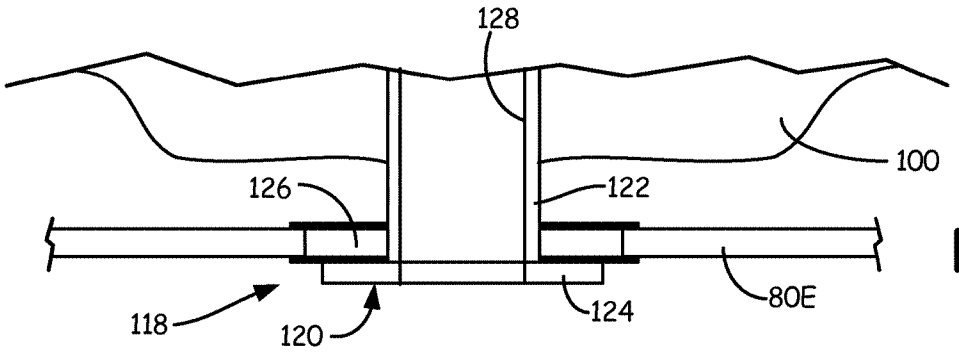
FIG. 7B is a section view through the slip joint of FIG. 7A taken at section 7B-7B showing a bushing and a slot.

FIG. 7A is a close-up view of a second embodiment of a slip joint suitable for use with heat shield 80 of FIG. 4. Slip joint 118 includes bushing 120, which comprises sleeve 122 and lip 124. FIG. 7B is a section view through slip joint 118 of FIG. 7A taken at section 7B-7B showing sleeve 122 of bushing 120 inserted through slot 126. FIG. 7B shows slip joint 118 from an aft looking forward viewpoint, with fastener 102 omitted for simplicity. FIG. 7C is a top view of slot 126 through heat shield segment 80E through which bushing 120 of FIG. 7B is configured to extend. For reference, slip joint 118 may be employed at the location of fixed join 84 in FIG. 4, but may be incorporated at any point between heat shield 80 and fairing 46.

Inner heat shield segment 80E includes slot 126 that permits bushing 120 and fastener 102 to pass through heat shield 80 to couple to bore 128 (FIG. 7B) in pad 100.

Sleeve 122, which comprises an annular cylindrical body, passes through slot 126, while lip 124 is disposed radially outward of slot 126, thereby trapping inner heat shield segment 80E between lip 124 and pad 100. Fastener 102 extends into sleeve 122 to couple to bore 128. As shown in FIG. 7B, sleeve 122 may extend partially into bore 128, but in other embodiments, sleeve my have a slightly larger diameter than bore 128 so as to terminate at the engagement with pad 100.

FIG. 7C shows length L and width W of slot 126. As shown in FIG. 7A, slot 126 has a length that is closely sized to the diameter of sleeve 122 to prevent inner heat shield segment from slipping over lip 124. As shown in FIG. 7B, slot 126 may be wider than both sleeve 122 and lip 124 to allow inner heat shield segment 80E to move around bushing 120, thereby accommodating thermal contractions and expansions of heat shield 80. Slot 126 is thus sized to allow movement of inner heat shield segment 80E in the circumferential direction, but to limit axial movement of inner heat shield segment 80E. Slot 126 may be re-oriented ninety degrees with reference to the orientation of FIG. 7C to allow inner heat shield segment 80E to move axially, but not circumferentially. Radial movement of inner heat shield segment 80E is inhibited by lip 124. The amount of freedom of movement of inner heat shield segment 80E can may be adjusted based on design needs by changing the dimensions of sleeve 122, lip 124, length L and width W in other embodiments. Slip joint 118 thus comprises a mechanical coupling that loosely secures heat shield 80 to fairing 46. Fastener 102 preload is taken up by bushing 120 and not through heat shield 80, thus enabling slip joint 118 to provide the freedom of movement described above.

Although the present disclosure describes coupling of inner heat shield segment 80E to inner ring 56, slip joint 82, fixed joint 84 and slip joint 118 may be used to couple other segments of heat shield 80 to fairing 46. Likewise, although the present disclosure describes slip joint 82 and fixed joint 84 operating in unison to secure inner heat shield segment 80E, each mechanical coupling may be used alone or in any other combination with the same or other mechanical couplings.

Discussion of Possible Embodiments

The following are non-exclusive descriptions of possible embodiments of the present invention:

A turbine exhaust case comprising: a frame comprising: an outer ring; an inner ring; and a plurality of struts joining the outer ring and the inner ring to define a load path between the outer ring and the inner ring; a fairing comprising a structure that lines the load path; a heat shield disposed between the frame and the fairing; and a mechanical linkage that couples the heat shield to the fairing.

The turbine exhaust case of the preceding paragraph can optionally include, additionally and/or alternatively, any one or more of the following features, configurations and/or additional components:

A mechanical linkage prevents the heat shield from moving radially, axially and circumferentially relative to the fairing.

A mechanical linkage comprising: a fastener extending through the heat shield and engaged with the fairing; and the fairing includes: a thickened region; and a bore extending into the thickened region to receive the fastener.

A mechanical linkage further comprising: an insert disposed in the bore and into which the fastener extends; and a fairing further comprising: a boss surrounding the bore and extending from the thickened region.

A mechanical linkage that permits the heat shield to move axially and circumferentially relative to the fairing, but inhibits radial movement of the heat shield relative to the fairing.

A mechanical linkage comprising: a flange extending from the fairing to form a slot; wherein the second end of the heat shield is inserted into the slot.

A mechanical linkage comprising: a bushing extending from the fairing; an oblong opening in the heat shield and through which the bushing extends; a lip extending from the bushing to prevent the oblong slot from disengaging the bushing; and a threaded fastener extending through the bushing and into a bore to secure the bushing to the fairing.

A heat shield comprising a plurality of uncoupled segments that form a line-of-sight barrier between the fairing and the frame.

A system for mounting a heat shield within a turbine structural case, the system comprising: a fairing for lining a turbine structural case; a heat shield comprising a thin-walled structure spaced from and extending across the fairing within the turbine structural case; and a slip joint coupling the heat shield to the fairing.

The system for mounting a heat shield of the preceding paragraph can optionally include, additionally and/or alternatively, any one or more of the following features, configurations and/or additional components:

A slip joint that permits the heat shield to move axially and circumferentially relative to the fairing, but inhibits radial movement of the heat shield relative to the fairing A slip joint comprising: a shelf extending from the fairing to form a slot; wherein an end of the heat shield is inserted into the slot.

A shelf comprising: an axial projection against which the end of the heat shield engages; and a radial projection spacing the axial projection from the fairing.

A heat shield further comprising a hook disposed at the end; and a shelf including a window to receive the hook.

A slip joint comprising: a bushing extending from the fairing; an opening in the heat shield and through which the bushing extends; and a lip extending from the bushing to prevent the heat shield from disengaging the bushing.

A thickened region of the fairing forming a pad; a bore extending into the pad; and a threaded fastener extending through the bushing and into the bore to secure the bushing to the fairing.

An opening having an oblong shape in a circumferential direction.

A system for mounting a heat shield within a turbine structural case, the system comprising: a fairing for lining the turbine structural case; a heat shield comprising a thin-walled structure spaced from and extending across the fairing within the turbine structural case; and a fixed joint coupling the heat shield to the fairing at a thickened location.

The system for mounting a heat shield of the preceding paragraph can optionally include, additionally and/or alternatively, any one or more of the following features, configurations and/or additional components:

A fixed joint that prevents the heat shield from moving radially, axially and circumferentially relative to the fairing.

A thickened location of the fairing forms a pad; and a fairing that further includes: a bore extending into the pad; and a threaded fastener extending through the heat shield and into the bore to secure the bushing to the fairing.

A fixed joint further comprising: an insert disposed in the bore to receive the fastener.

A fairing further comprising: a boss surrounding the bore and extending from the thickened location.

A turbine exhaust case comprises: a frame comprising: an outer ring; an inner ring; and a plurality of struts joining the outer ring and the inner ring to define a load path between the outer ring and the inner ring; a fairing comprising a ring-strut-ring structure that lines the load path; and a multi-piece heat shield disposed between the frame and the fairing to inhibit heat transfer between the frame and the fairing.

The turbine exhaust case of the preceding paragraph can optionally include, additionally and/or alternatively, any one or more of the following features, configurations and/or additional components:

A multi-piece heat shield comprising: a first segment extending axially between the frame and the fairing from a first end to a second end; and a second segment extending axially between the frame and the fairing from a third end to a fourth end; wherein the second end and the third end overlap to provide a line-of-sight obstruction between the frame and the fairing.

A third segment joined to the first segment and extending radially between the frame and the fairing; a fourth segment joined to the second segment and extending radially between the frame and the fairing; and a fifth segment joined to the fourth segment and extending axially between the frame and the fairing.

A first end and a fourth end that are coupled to the turbine exhaust case using mechanical linkages; and a second end and a third end that are cantilevered.

A mechanical linkage comprises a slip joint coupling the heat shield to the fairing.

A mechanical linkage comprises a fastener coupling the heat shield to a thickened region of the fairing.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine exhaust case comprising:

a frame comprising:

an outer ring;

an inner ring; and a plurality of struts joining the outer ring and the inner ring to define a load path between the outer ring and the inner ring;

a fairing comprising a structure that lines the load path;

a heat shield disposed between the frame and the fairing to inhibit heat transfer between the frame and the fairing, wherein the heat shield comprises:

a first inner heat shield segment extending axially between the inner ring of the frame and the fairing from a first end to a second end; and a second inner heat shield segment extending axially between the inner ring of the frame and the fairing from a third end to a fourth end, wherein the second end and the third end overlap to provide a line-of-sight obstruction between the frame and the fairing, and wherein the first and second inner heat shield segments are separated to form a circuitous path extending between the frame and the fairing and between overlapping portions of the first and second inner heat shield segments;

a first mechanical linkage that couples the first inner heat shield segment to the inner ring of the frame; and a second mechanical linkage that couples the second inner heat shield segment to the fairing.

2. The turbine exhaust case of claim 1 wherein the first mechanical linkage prevents the first inner heat shield segment from moving radially, axially and circumferentially relative to the inner ring of the frame.

3. The turbine exhaust case of claim 1 wherein:

the second mechanical linkage comprises:

a fastener extending through the heat shield and engaged with the fairing; and an insert into which the fastener extends; and the fairing includes:

an inner ring extending along the inner ring of the frame and positioned radially outward from the first and second inner heat shield segments;

a thickened region extending from the inner ring, wherein the thickened region is thicker than the inner ring of the fairing;

a bore extending into the thickened region to receive the fastener, wherein the bore extends in a through-thickness direction of the thickened region, and wherein the insert is disposed in the bore; and a boss surrounding the bore and extending from the thickened region.

4. The turbine exhaust case of claim 1 wherein the second mechanical linkage permits the second inner heat shield segment to move axially and circumferentially relative to the fairing, but inhibits radial movement of the second inner heat shield segment relative to the fairing.

5. The turbine exhaust case of claim 1 wherein the second mechanical linkage comprises:

a flange extending from the fairing to form a slot, wherein a third end of the second inner heat shield segment is inserted into the slot;

a bushing extending from the fairing;

an oblong opening in the second inner heat shield segment and through which the bushing extends;

a lip extending from the bushing to prevent the oblong slot from disengaging the bushing; and a threaded fastener extending through the bushing and into a bore to secure the bushing to the fairing.

6. The turbine exhaust case of claim 1 wherein the first and second inner heat shield segments are two of a plurality of uncoupled segments that form a line-of-sight barrier between the fairing and the frame.

7. The turbine exhaust case of claim 1 and further comprising:

a forward heat shield segment joined to the first heat shield segment and extending radially between the frame and the fairing;

an aft heat shield segment joined to the second inner heat shield segment and extending radially between the frame and the fairing; and an outer heat shield segment joined to the aft heat shield segment and extending axially between the frame and the fairing.

8. The turbine exhaust case of claim 1 wherein:

the first end is coupled to the turbine exhaust case using the first mechanical linkage;

the fourth end is coupled to the fairing using the second mechanical linkage; and the second end and the third end are cantilevered.

9. A system for mounting a heat shield within a turbine structural case, the system comprising:

a fairing for lining the turbine structural case;

a heat shield comprising a thin-walled structure spaced from and extending across the fairing within the turbine structural case, wherein the heat shield includes a segment extending from a first end to a second end, the second end forming a hook;

a slip joint coupling the second end of the segment to the fairing, wherein the slip joint comprises:

a shelf formed by a radial projection extending from the fairing and an axial projection extending from the radial projection, wherein the axial projection is spaced from the fairing by the radial projection; and a slot formed in the axial projection of the shelf adapted to receive the hook, wherein the segment extends between the fairing and the axial projection of the shelf;

a fixed joint coupling the first end of the segment to the fairing at a thickened location of the segment having an increased thickness relative to an adjacent portion of the segment.

10. The system of claim 9 wherein:

the slip joint permits the segment of the heat shield to move axially and circumferentially relative to the fairing, but inhibits radial movement of the segment relative to the fairing; and the fixed joint prevents the segment of the heat shield from moving radially, axially and circumferentially relative to the fairing.

11. The system of claim 9 and further comprising:

a pad formed by the thickened location of the fairing;

a bore extending into the pad along a through-thickness direction of the pad; and a threaded fastener extending through a bushing and into the bore to secure the bushing to the fairing.

12. A turbine exhaust case comprising:

a frame comprising:

an outer ring;

an inner ring; and a plurality of struts joining the outer ring and the inner ring to define a load path between the outer ring and the inner ring;

a fairing comprising a structure that lines the load path;

a heat shield disposed between the frame and the fairing to inhibit heat transfer between the frame and the fairing, wherein the heat shield comprises:

a first inner heat shield segment extending axially between the inner ring of the frame and the fairing from a first end to a second end; and a second inner heat shield segment extending axially between the inner ring of the frame and the fairing from a third end to a fourth end, wherein the second end and the third end overlap to provide a line-of-sight obstruction between the frame and the fairing;

a first mechanical linkage that couples the first inner heat shield segment to the inner ring of the frame; and a second mechanical linkage that couples the second inner heat shield segment to the fairing, wherein the second mechanical linkage comprises:

a flange extending from the fairing to form a slot, wherein a third end of the second inner heat shield segment is inserted into the slot;

a bushing extending from the fairing;

an oblong opening in the second inner heat shield segment and through which the bushing extends;

a lip extending from the bushing to prevent the oblong slot from disengaging the bushing; and a threaded fastener extending through the bushing and into a bore to secure the bushing to the fairing.

* * * * *